United States Patent [19]

Rhodes

[11] 4,041,568

[45] Aug. 16, 1977

[54] VACUUM CLEANER

[76] Inventor: William A. Rhodes, 4421 N. 13th Place, Phoenix, Ariz. 85016

[21] Appl. No.: 722,732

[22] Filed: Sept. 13, 1976

Related U.S. Application Data

[63] Continuation-in-part of Ser. No. 574,406, May 5, 1975, abandoned.

[51] Int. Cl.[2] ..... A47L 5/26

[52] U.S. Cl. ..... 15/344; 15/385; 15/386

[58] Field of Search ..... 15/344, 383, 385, 386

[56] References Cited

U.S. PATENT DOCUMENTS

| | | | |
|---|---|---|---|
| 935,558 | 9/1909 | Spangler | 15/385 X |
| 1,007,888 | 11/1911 | Parker | 15/344 X |
| 2,476,537 | 7/1949 | Erickson | 15/383 |
| 2,578,549 | 12/1951 | Hooban | 15/344 |
| 2,644,189 | 7/1953 | Calvin | 15/344 |
| 2,809,390 | 10/1957 | DeGötzen | 15/344 |
| 3,872,539 | 3/1975 | Doyel | 15/344 |

FOREIGN PATENT DOCUMENTS

| | | | |
|---|---|---|---|
| 945,037 | 12/1963 | United Kingdom | 15/385 |
| 685,208 | 12/1952 | United Kingdom | 15/383 |

*Primary Examiner*—Christopher K. Moore

[57] ABSTRACT

The disclosure relates to a small vacuum cleaner to be used by one hand of an operator and particularly for vacuum cleaning small areas and objects such as clothing or other areas such as furniture where lint or other foreign matter accumulates. The said vacuum cleaner comprises a centrifugal impeller mounted in a housing wherein a flexible portion of the impeller extends through an inlet opening in the centrifugal compressor and the flexible portion extends beyond the housing at the inlet opening such as to be capable of rubbing and flapping foreign matter loose from a surface being cleaned so that when the material is loosened it is entrained in the air stream going into the impeller housing through the inlet opening therein. The disclosure also relates to a novel impeller having its peripheral portion made of a flexible material and operating adjacent an inner annular wall of the compressor housing so that lint such as hair and other foreign matter may be rolled into a ball shaped mass and may be dumped out through the inlet opening of the housing when operation of the impeller has stopped and it is in a rest position.

7 Claims, 5 Drawing Figures

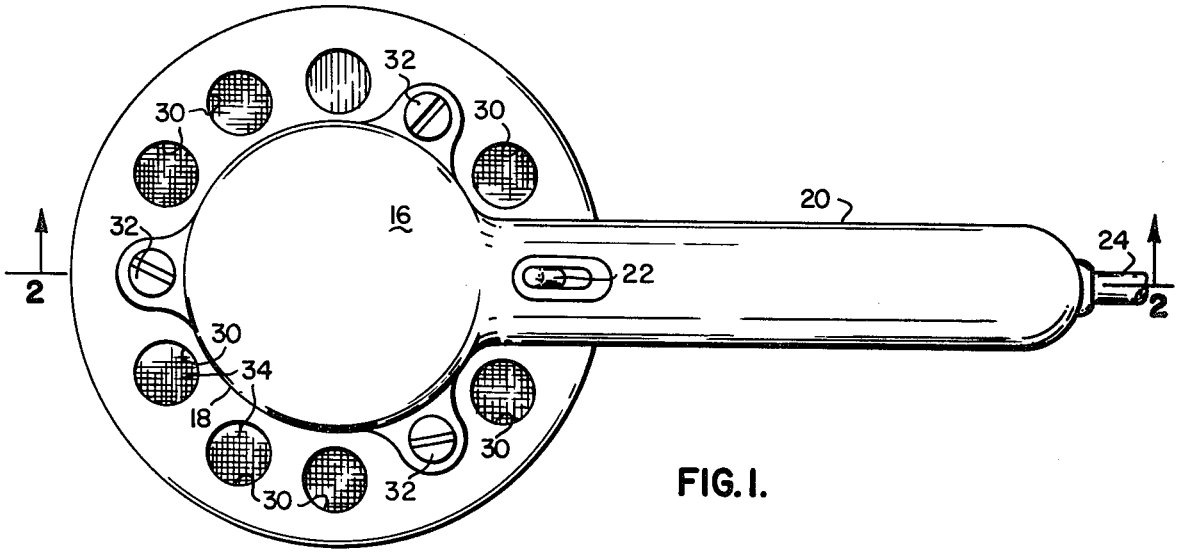
FIG. 1.
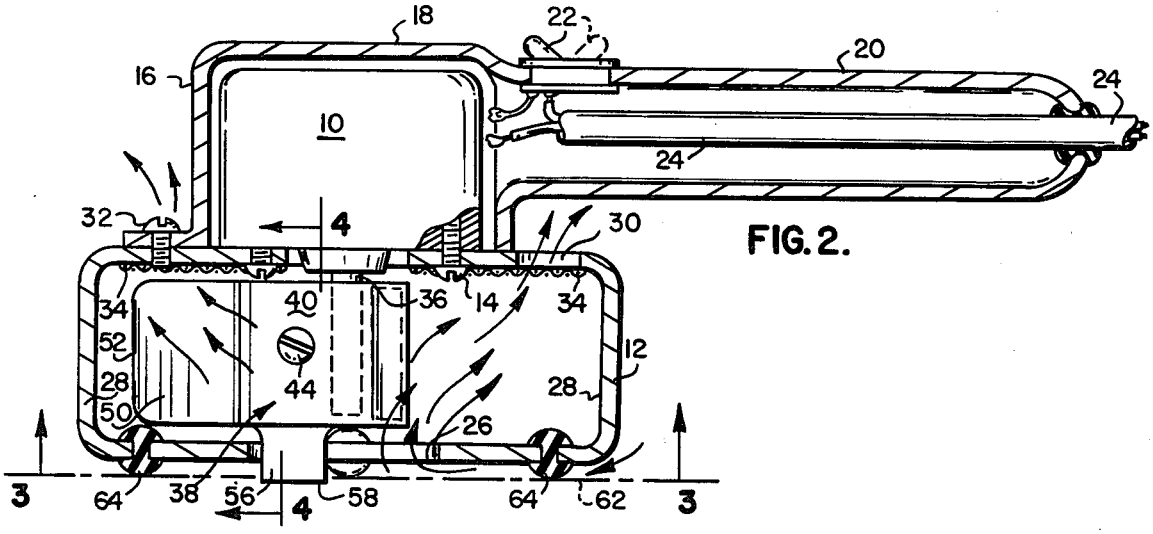
FIG. 2.
FIG. 3.
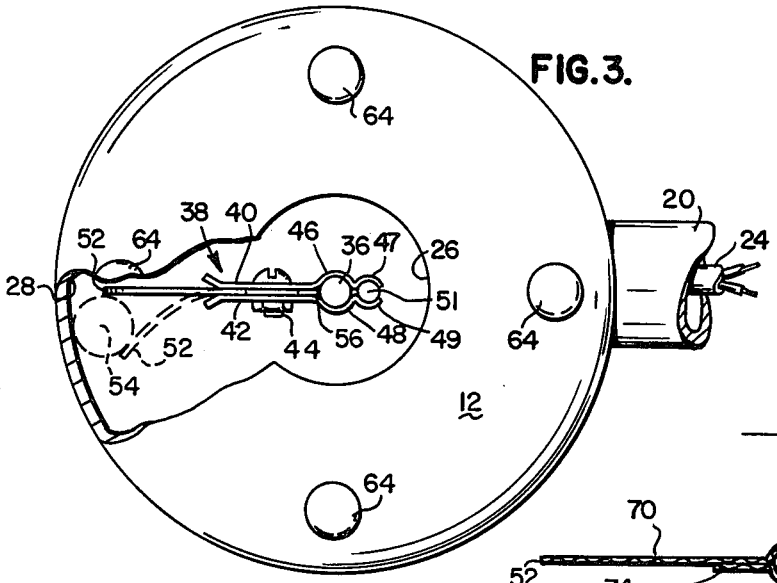
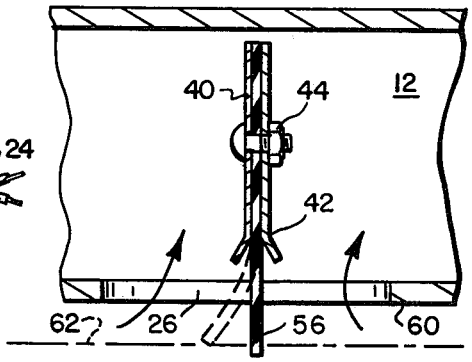
FIG. 4.
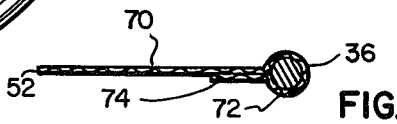
FIG. 5.

VACUUM CLEANER

This application is a continuation-in-part of my copending application, Ser. No. 574,406 Filed May 5, 1975, and now abandoned, for Vacuum Cleaner.

BACKGROUND OF THE INVENTION

Various vacuum cleaners and especially large vacuum cleaners used to operate on floor carpeting have employed various means for creating a vacuum in the area of a mechanical beater which impinges either bristles or other brush like elements into the nap of the rug for loosening the materials therefrom and for placing it into the air stream entering the vacuum cleaner. These prior art machines are large and relatively complicated and not usable in removing lint from clothing or smaller articles and especially from some portions of upholstery or the like. The small prior art vacuum cleaners which have been available for the purpose of cleaning small articles have only provided vacuum for removing foreign matter from various surfaces and, in many instances, hair or other foreign matter tends to cling tightly to some fabrics and the vacuum of such small vacuum cleaners has been incapable of removing such foreign matter from various articles such as clothing, upholstery and other surfaces.

SUMMARY OF THE INVENTION

The present invention relates to a small vacuum cleaner which may be held in a person's hand and which may be used to clean clothing, various areas of upholstery or other areas which cannot be cleaned because large vacuum cleaners may not have access to such small areas. The vacuum cleaner of the presnet invention having a novel centrifugal impeller disposed in a housing of generally annular form and provided with a central inlet opening through which a flexible element of the impeller projects beyond the housing so as to flap or rub against clothing or other surfaces during rotation of the impeller in the housing whereby the flapper portion mechanically engages and dislodges or removes the foreign matter such as hair or lint from the surface being cleaned so that it is automatically entrained in the air stream entering the inlet of the impeller housing and the impeller is provided with a main impeller portion which extends radially in the housing to a terminal portion thereof which is spaced from the internal annular wall of the housing so as to permit lint, hair or other foreign matter to be rolled into a ball between the terminal end of the flexible impeller and the annular wall of the impeller housing and after such has been accomplished, the ball of foreign material so rolled can be readily dumped out of the housing through the inlet opening of the compressor after the rotation of the impeller has stopped.

The impeller is driven by the shaft of the motor carried on the impeller housing and the impeller is preferably a single blade impeller radially extending from the shaft and this impeller is very light in weight preferably made of lightweight materials such as nylon fabric or the like and/or plastics so as to create a minimum of an unbalance problem and the aforementioned flapper portion which extends outwardly through the inlet opening is extended radially a distance comparable to a major portion of the radius of the circular inlet opening of the impeller housing.

Additionally, standoff feet are disposed on the side of the housing so as to hold the housing away from a surface being cleaned in order to allow air flow between the surface being cleaned and the housing and in addition, the length of the flapper portion is such that it extends slightly beyond the plane at which the standoff feet are extended so that when the standoff feet are placed on a flat surface, the flapper portion of the impeller is engageable with said surface and whereby air flows between the surface and the housing due to the spaced relation provided by the standoff feet.

Accordingly, it is an object of the invention to provide a very simple, durable and efficient hand held vacuum cleaner for use in cleaning various objects such as clothing, upholstery and the like.

Another object of the invention is to provide a novel construction of a vacuum cleaner wherein a centrifugal impeller housing has an inlet opening and wherein an impeller is rotatably mounted with one portion of the impeller extending radially from a motor shaft in the housing and the other portion of the impeller extending outwardly through the inlet opening of the compressor so as to engage surfaces being cleaned to dislodge foreign matter therefrom such that the foreign matter is entrained in the air stream entering the inlet opening of the impeller housing.

Another object of the invention is to provide a novel vacuum cleaner wherein a single blade impeller is flexible and spaced from an inner annular wall of the impeller housing such that when the impeller rotates, it rolls lint and other foreign matter into a small ball which may later be dropped out of and removed through the inlet opening of the impeller housing after the rotation of the impeller has stopped.

Another object of the invention is to provide a very simple, economical and highly efficient vacuum cleaner which may be operated in one hand of an operator.

Another object of the invention is to provide a very small and very efficient vacuum cleaner which may provide access to spaces and surfaces which cannot be serviced by conventional vacuum cleaners.

Another object of the invention is to provide a small vacuum cleaner which is capable of removing lint, hair and other objects which tend to cling tenaciously to various surfaces.

Further objects and advantages of the invention may be apparent from the following specification, appended claims and accompanying drawings.

BRIEF DESCRIPTION OF THE DRAWINGS

FIG. 1 is a top or plan view of the vacuum cleaner of the invention;

FIG. 2 is an axially sectional view thereof taken from the line 2—2 of FIG. 1;

FIG. 3 is a fragmentary bottom plan view of the vacuum cleaner taken from the line 3—3 of FIG. 2;

FIG. 4 is a fragmentary sectional view taken from the line 4—4 of FIG. 2; and FIG. 5 is a fragmentary sectional view of a modification of the invention taken on a plane similar to FIG. 3.

DESCRIPTION OF THE PREFERRED EMBODIMENTS

As shown in the drawings, the vacuum cleaner of the invention is a small vacuum cleaner such as may be used in a person's hand and the drawings show this vacuum cleaner approximately in full scale. This is a vacuum cleaner for cleaning areas of upholstery, clothing or other similar areas and is very simple and effective in its cleaning action and is small so as to be useful in areas inaccessible to usual vacuum cleaners such as found in the home.

As shown in FIG. 1 of the drawings, a motor 10 is mounted on a centrifugal blower housing 12 which is fixed to the motor by means of screws 14. Extending over the motor 10 is a motor housing and handle structure 16 which is provided with a motor enclosing portion 18 and a handle portion 20 which may be grasped in the hand of an operator. Mounted on the handle 20 is a toggle switch 22 electrically coupled to the motor and to an electrical cord 24 which may be coupled to a conventional 110 volt AC outlet. The housing 12, as shown in section in FIG. 2 of the drawings, is provided with a central inlet opening 26; this inlet 26 being generally circular and substantially concentric with an internal annular wall 28 of the housing 12. The housing 12 is provided with an annular row of outlets 30 which surround the motor housing portion 18 of the housing and handle structure 16. It will be seen that this houding and handle structure 16 is secured to the impeller housing 12 by means of screws 32 which are screwthreaded into the upper wall of the impeller housing 12 as shown best in FIG. 2 of the drawings.

On the inner side of the housing 12, a screen structure 34 covers the impeller housing outlet openings 30 so as to prevent the escape of lint or other material collected in the housing as the vacuum cleaner of the invention is operated.

The motor 10 is provided with a shaft 36 which carries a centrifugal impeller 38. This centrifugal impeller 38 may be fixed to the shaft 36 in various ways and is preferably of lightweight material such as thin aluminum and flexible elements as will be hereinafter described.

In the specific form as shown, the impeller 38 comprises a pair of lightweight aluminum clamp plates 40 and 42 held together by a bolt and nut assembly 44 and the clamp plates 40 and 42 are provided with shaft gripping portions 46 and 48 respectively which grip the shaft 36 to hold the impeller 38 fixed thereon.

As shown in FIGS. 2 and 3, the gripping portions 46 and 48 are provided with integral counterweight holding portions 47 and 49, these portions being arcuate in cross section and are clamped against opposite sides of a counterweight 51 which may be of dense material such as lead or the like so as to provide a counterbalance for the entire rotor assembly about the axis of the shaft 36; it being noted that the counterweight 51 is opposed to the plates 40 and 42 and the flapper 56 with respect to the axis of the shaft 36.

Clamped between the plates 40 and 42 is a flexible nylon fabric impeller portion 50 which is flexible and it will be understood that even though nylon fabric may be preferred, other suitable materials may be used.

The impeller portion 50 is provided with a radially extending extremity 52 which is spaced from the internal annular wall 28 of the impeller housing 12 so as to permit the extremity 52 of the impeller portion 50 to deflect into the broken line position as shown in FIG. 3 when a ball of lint, hair or other foreign matter as represented by broken lines 54 collects in the housing and is rolled around on the inner annular wall 28. Thus, the spacing of the extremity 52 of the impeller portion 50 is such that it centrifugally impels lint or other material outwardly against the annular wall 28 and this material rolls around until it is formed into a ball which may later be dumped out through the generally circular compressor inlet opening 26 after rotation of the impeller 38 has stopped.

The impeller 38 is provided with an extending flapper portion 56 which has an extremity 58 which extends outside the impeller housing 12 and therebeyond and through the inlet opening 26 as shown best in FIGS. 2, 3 and 4 of the drawings. This flapper portion 56 is flexible, preferably made of nylon fabric or the like, and its terminal edge 58 extends substantially beyond the inlet side 60 of the housing 12 as shown best in FIG. 4, and as shown in FIG. 4, this flapper portion at its extremity 58 is deflectable and is adapted to flap against and rub a surface designated 62, such surface being any surface on which foreign matter has been accumulated and on which the flapper 58 is activated as the impeller rotates with the shaft 36 so as to rub and flap the material loose from the surface so that it may be entrained in an air stream entering the inlet opening 26 as indicated by the arrows in FIGS. 2 and 4 of the drawings.

As shown in FIG. 5 of the drawings, the shaft 36 is similar to the shaft 36 hereinbefore described, and the impeller and flapper of the invention is designated 70 and is made of very thin lightweight nylon fabric and is wrapped around the shaft 36 at 72 and is overlapped at 74 and the portion 72 and the portion 74 are bonded with epoxy or other cement so as to fix the impeller flapper 70 on the shaft 36. This impeller flapper 70 is of such thin lightweight nylon that its weight is very nominal and the weight thereof being such that the ratio of the weight of the impeller 70 to the remaining structure, such as the shaft 36 and motor rotor is conducive to operation without objectional vibration.

The flapper 70 includes an extremity 52 as hereinbefore described and also an extension 56 similar to that shown in FIG. 2 of the drawings and also in FIG. 4 of the drawings.

On the inlet side of the housing 12 and disposed outwardly from the inlet opening 26 are standoff feet designated 64. These feet 64 are adapted to hold the inlet side of the housing 12 and the inlet opening 26 in spaced relationship to the surface 62 being cleaned so that air may flow between the surface and the housing 12 radially inward and into the inlet opening 26, it being noted that the extremity 58 of the flapper portion 56 of the impeller extends away from the inlet side 60 of the housing 12 a distance which exceeds the extension of the standoff 64 in the same direction so that the terminal edge 58 of the flapper 56 will always contact the surface 62 when the standoff feet 64 are engaged therewith.

It will be obvious to those skilled in the art that various modifications may be resorted to without departing from the spirit of the invention.

I claim:

1. In a vacuum cleaner: a housing having a motor mounted thereon having a motor shaft extending into said housing; a centrifugal impeller rotatably mounted on said motor shaft; said housing having an outlet and a circular inlet opening; said impeller adapted to create an air stream into said housing through said inlet and outwardly through said outlet; said impeller having a flexible flapper portion extending outwardly through said inlet opening beyond said housing; whereby during rotation and centrifugal air pumping operations of said impeller said flexible flapper portion may contact foreign matter on a surface being cleaned to thereby loosen said foreign matter into the air stream entering said inlet opening; said flapper portion extending radially away from the axis of said motor shaft a distance substantially equal to the radius of said housing inlet opening; said impeller being a single blade structure and provided with a radially extending flexible extremity spaced from and adjacent to the inside of said housing to allow lint to be rolled into a ball between the extremity of said impeller and the inner surrounding wall of said housing; whereby said ball may subsequently be dropped from said housing through said inlet opening after the motor is deenergized and the impeller has come to rest.

2. The invention as defined in claim 1, wherein: said housing is provided with standoff feet extending outwardly beyond said inlet opening so as to hold the inlet opening of said housing in spaced relation to a surface being cleaned to thereby permit air flow between the surface being cleaned and the housing to said inlet opening.

3. The invention as defined in claim 1, wherein: a motor cover is coupled to said housing, endoses said motor, and is provided with a laterally extending handle portion for use in handling the vacuum cleaner during operation thereof.

4. The invention as defined in claim 1, wherein: a screen is disposed over said outlet to prevent material collected in said housing from escaping to the atmosphere.

5. The invention as defined in claim 4, wherein: said housing is provided with one side at which said inlet is disposed; said housing having an opposite side in which said outlet is disposed; said screen being disposed on the inner side of said housing overlying said outlet.

6. The invention as defined in claim 5, wherein: said outlet comprises a plurality of openings.

7. The invention as defined in claim 6, wherein: said motor is mounted centrally of said housing said plurality of outlets are arranged in a substantially annular manner outwardly of and generally concentrically with said motor; a motor housing is secured to said housing outwardly relative to said motor and inwardly relative to said annular row of outlets; said handle having a radially extending handle portion extending radially relative to the axis of said motor shaft.

* * * * *